US008887345B2

(12) United States Patent
Gonzalez

(10) Patent No.: US 8,887,345 B2
(45) Date of Patent: Nov. 18, 2014

(54) CADET

(76) Inventor: Mark Gonzalez, Hollywood, SC (US)

( * ) Notice: Subject to any disclaimer, the term of this patent is extended or adjusted under 35 U.S.C. 154(b) by 171 days.

(21) Appl. No.: 13/366,146

(22) Filed: Feb. 3, 2012

(65) Prior Publication Data

US 2013/0198985 A1 Aug. 8, 2013

(51) Int. Cl.
*A63B 57/00* (2006.01)
*A46B 13/00* (2006.01)
*A46B 15/00* (2006.01)

(52) U.S. Cl.
USPC ..... 15/160; 15/161; 15/246; 15/179; 15/21.1

(58) Field of Classification Search
USPC ..... 15/160, 161, 246, 88.4, 49.1, 41.1, 42, 15/176.1–176.6, 202, 104.92, 205.2, 230, 15/179, 21.1, 22.2, 23, 28
See application file for complete search history.

(56) References Cited

U.S. PATENT DOCUMENTS

| | | | | |
|---|---|---|---|---|
| 3,747,150 | A * | 7/1973 | Kozub | 15/105 |
| 6,912,755 | B2 * | 7/2005 | Chen | 15/179 |
| 7,414,337 | B2 * | 8/2008 | Wilkinson et al. | 310/50 |
| 7,465,222 | B1 * | 12/2008 | Sun et al. | 451/342 |
| 2009/0311041 | A1 * | 12/2009 | Sockman et al. | 403/348 |

* cited by examiner

*Primary Examiner* — Mark Spisich
*Assistant Examiner* — Andrew A Horton
(74) *Attorney, Agent, or Firm* — Wilson D Swayze, Jr.

(57) ABSTRACT

A brush device for cleaning golf devices may include a connection device to connect a rotating shaft and a brush device to connect to the connection device. The rotating shaft may rotate the connection device to rotate the brush device, and the connection device may include a first hub to connect to the rotating shaft. The connection device may include a second hub to connect to the first hub. The connection device may include a ring being connected to the first hub.

4 Claims, 3 Drawing Sheets

CADET

FIELD OF THE INVENTION

The present invention relates to cleaning devices and more particularly to a device to clean golf clubs.

BACKGROUND

The game of golf presents participants with a unique mixture of challenge and recreation. Overall, golf is widely embraced by the international population, and there is a continual desire to overcome the challenges inherent in the game thus increasing a golfer's enjoyment of the sport.

With an ever increasing population of golfers, professional and recreational alike, the sophistication of golf equipment has grown by leaps and bounds, all in an effort to simplify this difficult sport. Golf clubs have taken advantage of different materials, such as graphite, and shapes to increase power and accuracy. Golf balls are also now made from a multitude of materials offering a golfers improved distance and accuracy. Even golf apparel has changed to keep the golfer comfortable and allow the unrestricted movement of the golfer's body during a swing. Golf shoes too have seen an evolution over the life of the sport in material selection and design.

The golf courses are subject to various weather conditions and as a consequence, the golf courses may range from wet and muddy to extremely dry. In a lot of cases, the golf ball lands in areas which may be less than optimal. In these cases, the individual must follow the golf ball into these wet and muddy areas. As a result, the golf shoes, golf clubs and even golf balls may be covered with mud and grime. This mud and grime should be cleaned off the golf equipment as soon as possible so as not to affect the golf game and not to affect the comfort level of the golf players. A brush is a natural device to clean golf clubs and other golf equipment.

SUMMARY

A brush device for cleaning golf devices may include a connection device to connect a rotating shaft and a brush device to connect to the connection device.

The rotating shaft may rotate the connection device to rotate the brush device, and the connection device may include a first hub to connect to the rotating shaft.

The connection device may include a second hub to connect to the first hub.

The connection device may include a ring being connected to the first hub.

The connection device may include a blade to connect the ring and the first hub.

The connection device may include an internal cover to cooperate with the first hub.

The connection device may include an external cover to cooperate with the second hub.

The rotating shaft may be connected to a golf push/pull cart.

BRIEF DESCRIPTION OF THE DRAWINGS

The invention may be understood by reference to the following description taken in conjunction with the accompanying drawings, in which, like reference numerals identify like elements, and in which.

DETAILED DESCRIPTION

Figure 1:
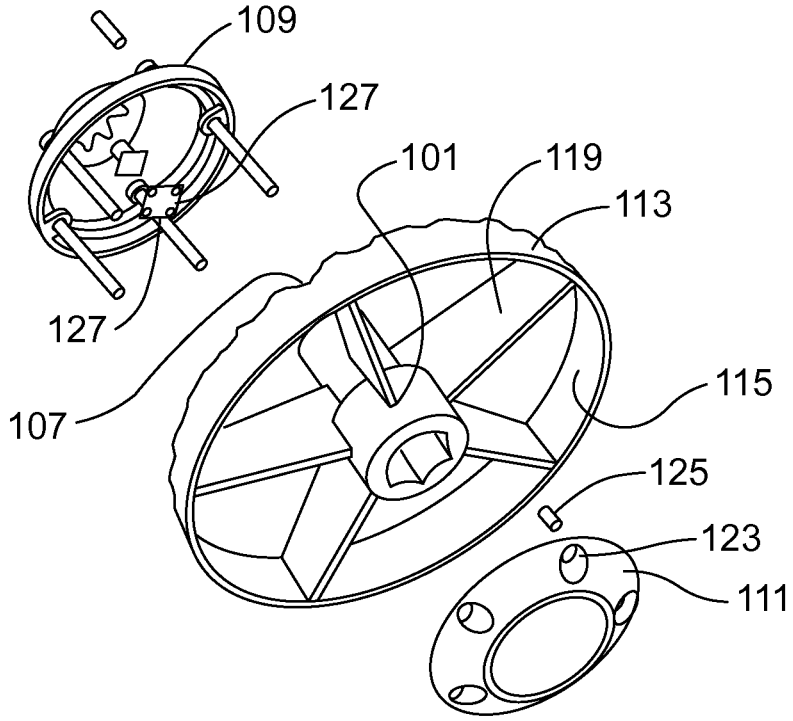
FIG. 1 illustrates an exploded view of the connection device of the present invention.

The Cadet or brush device 400 cleans golf club heads. The Cadet/brush device 400 mounts to the back tire of a push/pull cart or more particularly may connect to the golf cart shaft 201 of the golf cart 200. The hub (connection device 100) may stay attached to the cart after use but the brush (cleaning device 300) may be detachably connected and may be stored in the golf bag. When a golfer (user) swings their golf club several times, the golf club may need to be brushed off due to sand, wet grass, dirt etc. The Cadet/brush device 400 keeps the pace of play going on a golf course by speeding up the cleaning process. The golfer simply has to swing the club and begin walking to the next hole with the golf cart. As the golfer pushes the push/pull cart to the next shot the golfer places the club over the Cadet's brush (cleaning device 300) to clean the club as the golfer walks. The present invention may save 8 to 10 sec. per swing per golfer by eliminating the need to manually brush off and then wipe the club. In total, the golfer could save on average 10 min. per round of golf. Saving 10 min per golfer on a round of golf could add up to 40 min per round if the golfer is playing in groups. The Cadet not only keeps the pace of play moving along, and it also make golf courses more money.

The brush device 400 includes a connection device 100 and cleaning device 300. FIG. 1 illustrates an exploded view of the connection device of the present invention and illustrates that the connection device 100 may include a annular ring 113 which may include an inclined surface 115 and an end surface 114 which may be curved and which may be connected to the inclined surface 115. The connection device 100 may include a first hub 101 and a second hub 103 which may be axially aligned with the first hub 101 and which may be a cylinder and which may include a first aperture 105 which may extend through the first hub 101. The second hub 103 may be a cylinder and may include a second aperture 107 which may extend through the second hub 103. The first aperture 105 may be axially aligned with the second aperture 107. The connection device 100 may include radial extending blades 119 (arms) which may extend from the first hub 101 to the ring 113.

The connection device 100 may include an internal cover 111 which may include a first cover aperture 112 and which may have a periphery which may cooperate with the exterior surface of the first hub 101. The internal cover 111 may include a sloping surface. The connection device 100 may include an external cover 109 which may be opposed to the internal cover 111 which may include a second cover aperture 110 which may cooperate with the exterior surface of the second hub 103 which may include a sloping surface.

The first hub 101 and the second hub 103 may be sandwiched between the exterior cover 109 and the interior cover 111, and the exterior cover 109 may be connected by a first fastener 121 which may be a bolt and a second fastener 123 which may be a nut. The first fastener 121 may cooperate with a spacer 125 (sleeve) which may position the interior cover 111. FIG. 1 additionally illustrates a backup plate 127.

Figure 2:
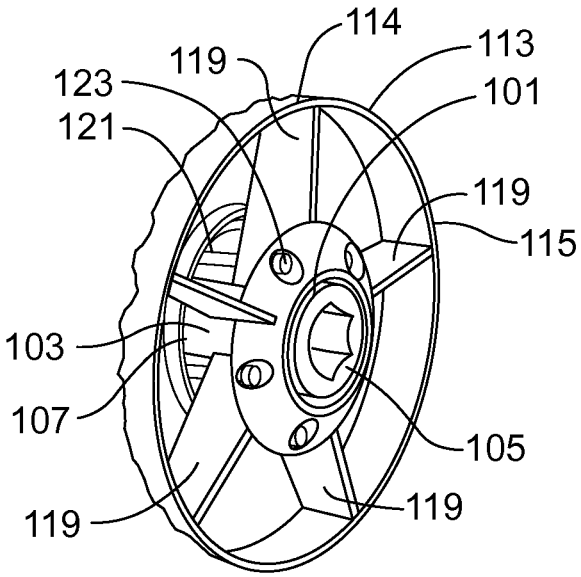
FIG. 2 illustrates a perspective view of the connection device of the present invention.

FIG. 2 illustrates a perspective view of the connection device of the present invention and illustrates that the connection device 100 may include an annular ring 113 which may include an inclined surface 115 and an end surface 114 which may be curved and which may be connected to the inclined surface 115. The connection device 100 may include a first hub 101 and a second hub 103 which may be axially aligned with the first hub 101 and which may be a cylinder and which may include a first aperture 105 which may extend through the first hub 101. The second hub 103 may be a cylinder and may include a second aperture 107 which may extend through the second hub 103. The first aperture 105 may be axially aligned with the second aperture 107. The connection device 100 may include radial extending blades 119 (arms) which may extend from the first hub 101 to the ring 113.

The connection device 100 may include an internal cover 111 which may include a first cover aperture 112 and which may have a periphery which may cooperate with the exterior surface of the first hub 101. The internal cover 111 may include a sloping surface. The connection device 100 may include an external cover 109 which may be opposed to the internal cover 111 which may include a second cover aperture 110 which may cooperate with the exterior surface of the second hub 103 which may include a sloping surface.

The first hub 101 and the second hub 103 may be sandwiched between the exterior cover 109 and the interior cover 111, and the exterior cover 109 may be connected by a first fastener 121 which may be a bolt and a second fastener 123 which may be a nut. The first fastener 121 may cooperate with a spacer 125 (sleeve) which may position the interior cover 111. FIG. 1 additionally illustrates a backup plate 127.

Figure 3:
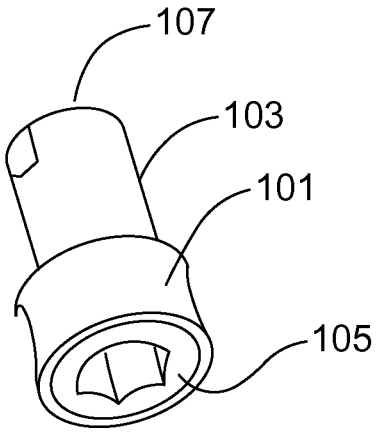
FIG. 3 illustrates a perspective view of the first hub and the second hub of the connection device of the present invention.

FIG. 3 illustrates a perspective view of the first hub 101 and a second hub 103 which may be axially aligned with the first hub 101 and which may be a cylinder and which may include a first aperture 105 which may extend through the first hub 101. The second hub 103 may be a cylinder and may include a second aperture 107 which may extend through the second hub 103. The first aperture 105 may be axially aligned with the second aperture 107.

Figure 4:
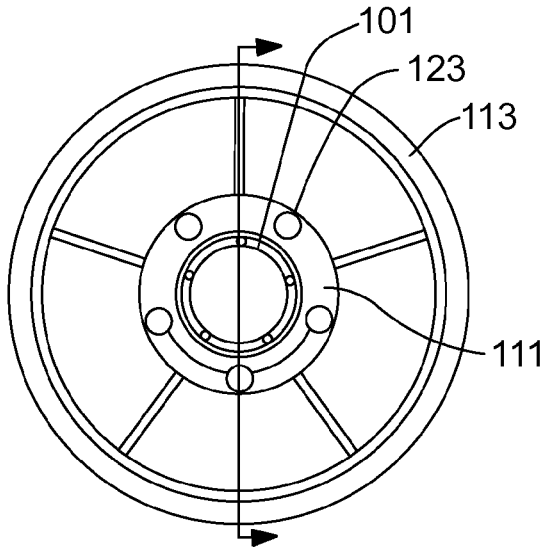
FIG. 4 illustrates a front view of the connection device of the present invention.

FIG. 4 illustrates a front view of the connection device 100 and illustrates the internal cover 111, the first hub 101, the ring 113, the second fastener 123, and the blades 119.

Figure 5:
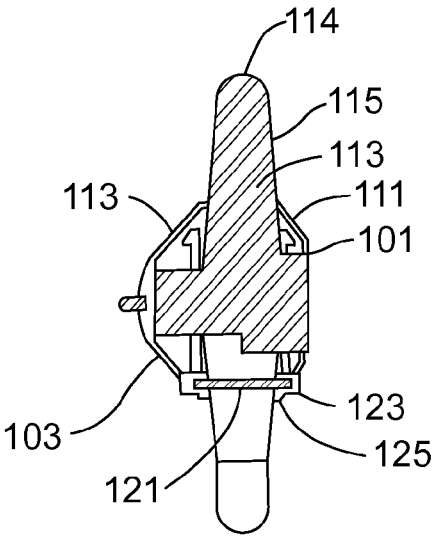
FIG. 5 illustrates a cross-sectional side view of the connection device of the present invention.
Figure 10:
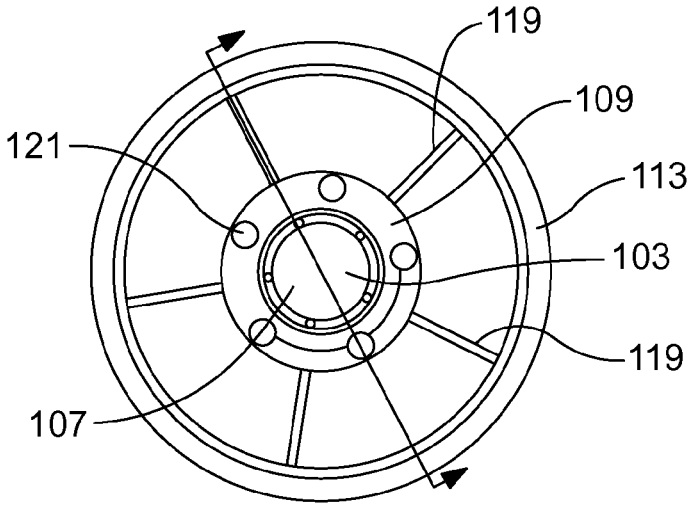
FIG. 10 illustrates a back view of the connection device of the present invention.

FIG. 5 illustrates a cross-sectional view of the connection device 100 and illustrates the ring 113 which may include the ring inclined surface 115 and the end surface 114, the internal cover 111, the external cover 113, the first hub 101, the second hub 103, the first fastener 121, the second fastener 123, and the spacer 125 FIG. 10 illustrates a back view of the connection device 100 and illustrates the external cover 109, the second hub 103, the second aperture 107, the ring 113, the first fastener 121 and the blades 119.

Figure 6:
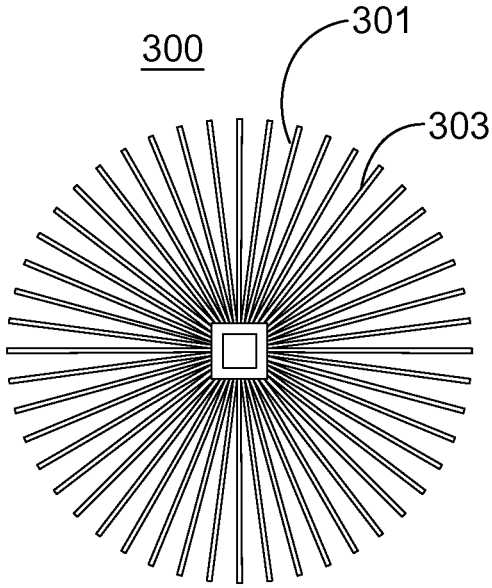
FIG. 6 illustrates a front view of the cleaning device of the present invention.

FIG. 6 illustrates a front view of the cleaning device 300 of the present invention and illustrates the cleaning device 300 may include flexible brush rods 301 which may extend radially and axially in order to brush off dirt and other grime from clubs and other golf equipment. The flexible brush rods 301 may be formed from plastic or other suitable material and may extend around the center shaft 303 and may be at an acute angle with respect to the center shaft 303. The center shaft 303 may cooperate and be retained by the second aperture 107 of the second hub 103 of the connection device 100.

Except as otherwise noted, the cleaning device 300 and the connection device 100 may be formed from rigid material such as plastic, metal or other suitable material.

Figure 7:
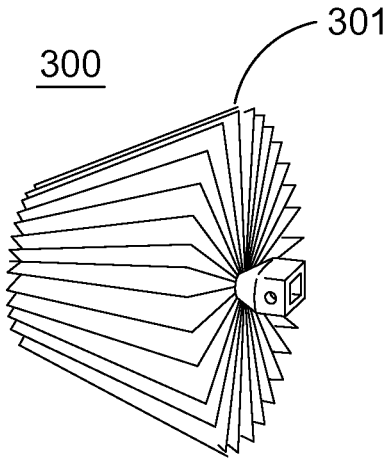
FIG. 7 illustrates a perspective view of the cleaning device of the present invention.

FIG. 7 illustrates a perspective view of the cleaning device 300 of the present invention and illustrates the cleaning device 300 may include flexible brush rods 301 which may extend simultaneously radially and axially in order to brush off dirt and other grime from clubs and other golf equipment. The flexible brush rods 301 may be formed from plastic or other suitable material and may extend around the center shaft 303 and may be at an acute angle with respect to the center shaft 303. The center shaft 303 may cooperate and be retained by the second aperture 107 of the second hub 103 of the connection device 100.

Figure 8:
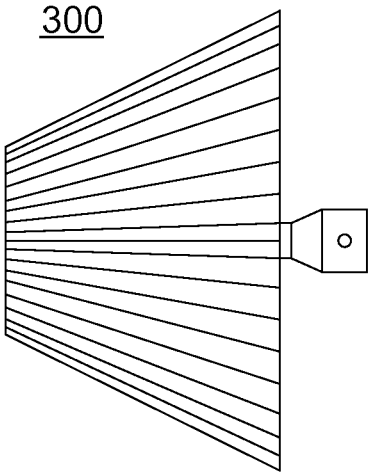
FIG. 8 illustrates a side view of the cleaning device of the present invention.

As illustrated in FIG. 8, the center shaft 303 may be positioned within the second hub 103 which may be connected to the golf cart shaft 201 of the golf cart 200.

The golf cart shaft 200 may cooperate and be retained within the first aperture 105 of the first hub 101.

Figure 9:
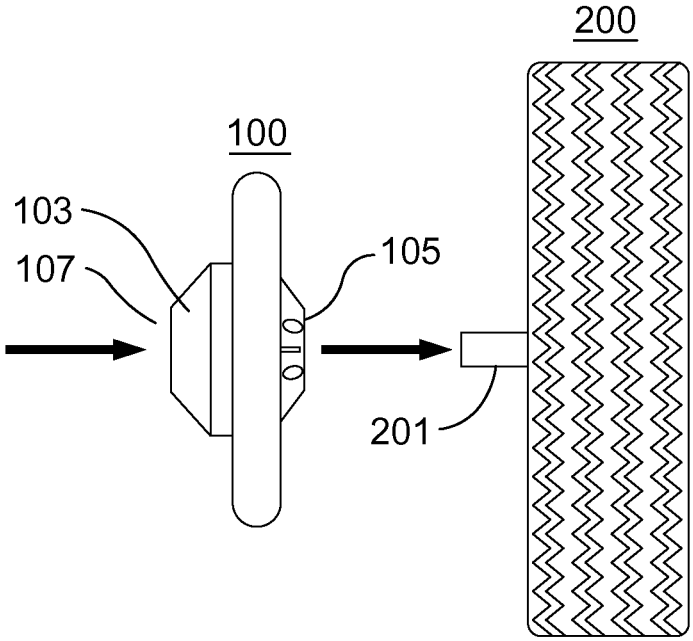
FIG. 9 illustrates a sectional view of the cleaning device of the present invention.

FIG. 9 illustrates a sectional view of the center shaft 303 of the cleaning device 300 (not shown).

As the golf cart shaft 201 rotates by action of the golf cart wheels or otherwise, the first hub 101 and the second hub 103 rotate with the golf cart shaft 201.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed.

The invention claimed is:

1. A brush device for cleaning golf devices, comprising: a connection device to connect a rotating shaft; a brush device to connect to the connection device; wherein the rotating shaft rotates the connection device to rotate the brush device; wherein the connection device includes a first hub to connect to the rotating shaft; wherein the connection device includes a second hub to connect to the first hub; wherein the connection device includes a ring being connected to the first hub; wherein the connection device includes a blade to connect the ring and the first hub; and wherein the connection device includes an internal cover to cooperate with the first hub.

2. A brush device for cleaning golf devices as in claim 1, wherein the connection device includes an external cover to cooperate with the second hub.

3. A brush device for cleaning golf devices as in claim 2, wherein the rotating shaft is connected to a golf cart.

4. A brush device for cleaning golf devices, comprising:

a connection device to connect a rotating shaft to a brush device in order to rotate the brush device;

wherein the connection device comprises a first hub which receives a rotating shaft, a second hub which is coupled to the first hub and receives a shaft of the brush device, a plurality of blades extending radially outward from an outer surface of the connection device, and a ring coupled to the plurality of blades and located radially outward from the plurality of blades.

* * * * *